United States Patent [19]

Schultz et al.

[11] 4,422,585

[45] Dec. 27, 1983

[54] TOILET PAPER DISPENSER WITH SLIDING MANDRELS

[75] Inventors: Arthur N. Schultz; James A. Diring; Donald G. Krueger, all of Green Bay, Wis.

[73] Assignee: Alwin Manufacturing Company, Inc., Green Bay, Wis.

[21] Appl. No.: 304,721

[22] Filed: Sep. 21, 1981

[51] Int. Cl.[3] ..... B65H 19/08; B65H 49/00

[52] U.S. Cl. ..... 242/55.53; 225/46; 312/37

[58] Field of Search ..... 242/55.2, 55.3, 55.53, 242/55.54; 225/46, 47; 312/37, 38

[56] References Cited

U.S. PATENT DOCUMENTS 2,299,736 10/1942 Cavoto ..... 242/55.3
2,518,328 9/1948 Janonis ..... 242/55.2 X
3,677,485 7/1972 Berg ..... 242/55.3
3,698,653 10/1972 Okamura ..... 242/55.3

FOREIGN PATENT DOCUMENTS 2367012 9/1978 France ..... 225/47

*Primary Examiner*—Stuart S. Levy
*Attorney, Agent, or Firm*—Henry C. Fuller

[57] ABSTRACT

A toilet paper dispenser employs two cantilevered mandrels movable in a track. In one track position the lower mandrel is in a dispensing position and, when exhausted, can be moved rearwardly to enable the other cantilevered mandrel to be dropped into a dispensing position. When the lower mandrel is in the dispensing position the guide block which supports the lower mandrel in the track supports the guide block for the second mandrel in an elevated storage, non-access position.

3 Claims, 6 Drawing Figures

TOILET PAPER DISPENSER WITH SLIDING MANDRELS

BACKGROUND OF THE INVENTION

In public facilities it is desirable to have toilet paper dispensers in which a spare roll is held in an inoperative stored position so that when one roll is exhausted the extra roll can readily be moved into a dispensing position. It is also desirable to have one roll exhausted before access is obtainable to the second roll. U.S. Pat. Nos. 3,698,653 and 3,677,485 are illustrative of dispensers of this type. In public dispensers it also is desirable that the core of the consumed spool be retained within the dispenser so that the attendant can properly dispose of the core so that it can't be used for clogging plumbing.

It is also desirable that dispensers of this type be inexpensive and involve a minimum of moving parts to minimize service and reduce expense.

SUMMARY OF THE INVENTION

The invention provides a toilet paper dispenser having relatively simple construction which accomplishes the foregoing objectives. Primary and secondary mandrels are cantilevered from mounting blocks which are guided by tracks on a cabinet side wall. First and second track portions intersect at a juncture which forms the dispensing position for the first mandrel. The tracks have inturned flange portions which capture the outturned flanges of the mounting blocks. The mounting block for the second mandrel is elongated and is supported by the mounting block of the first mandrel so that the second mandrel is in the storage position and not accessible through the dispensing or access opening.

The juncture of the first and second track portions is spaced from the rear cabinet wall so that the first mandrel cannot be moved from the juncture to the storage position until the paper on the first mandrel is almost completely exhausted. The paper roll acts as a stop against movement. When the first roll is exhausted the mounting block for the second mandrel can be moved into the juncture to provide access to the stored roll carried thereon. Once the stored roll is moved into the access position the first mandrel is retained in a rearward storage position.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
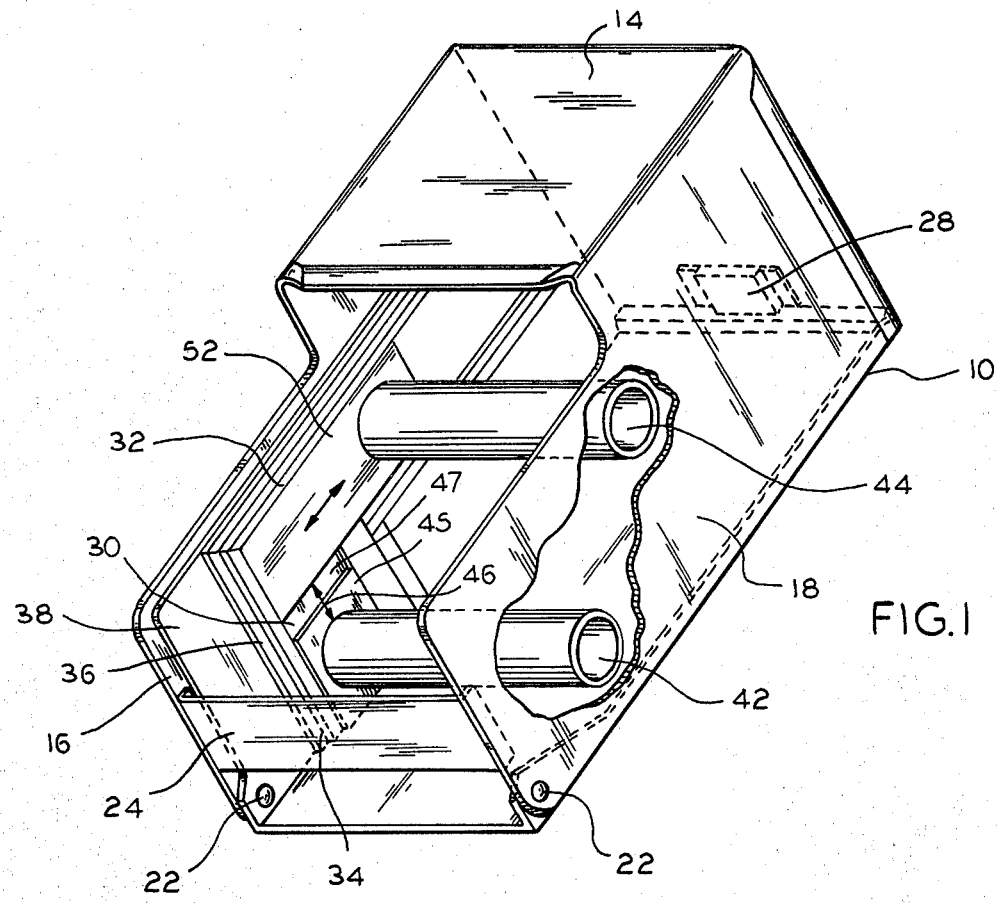
FIG. 1 is a perspective view of the paper roll dispenser of the invention with parts broken away.
Figure 2:
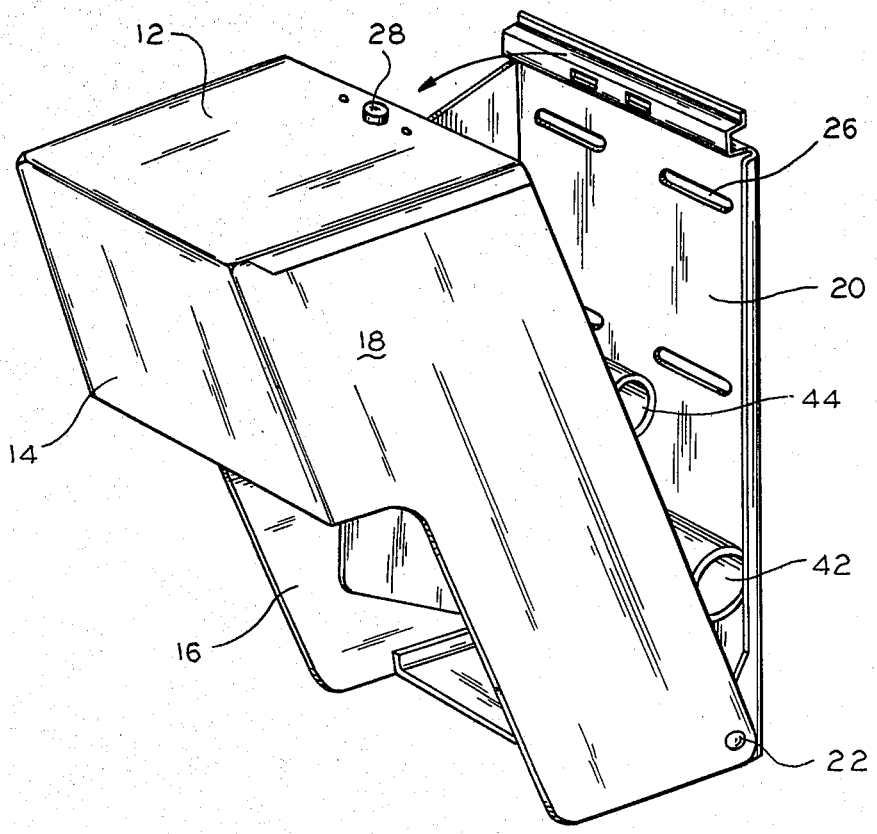
FIG. 2 is a side perspective view of the dispenser shown in FIG. 1.

In the drawings, FIG. 1 discloses a dispenser housing 10 having a top wall 12, a front wall 14, spaced side walls 16 and 18 and a rear wall or panel 20 which is hinged on the side walls by rivets or pins 22 (FIGS. 1 and 2). A bottom wall or strap 24 is also shown. The rear wall 20 can be provided with slots 26 for mounting. Some form of latch or lock 28 can also be employed for securing the rear panel 20 in the closed position.

Figure 3:
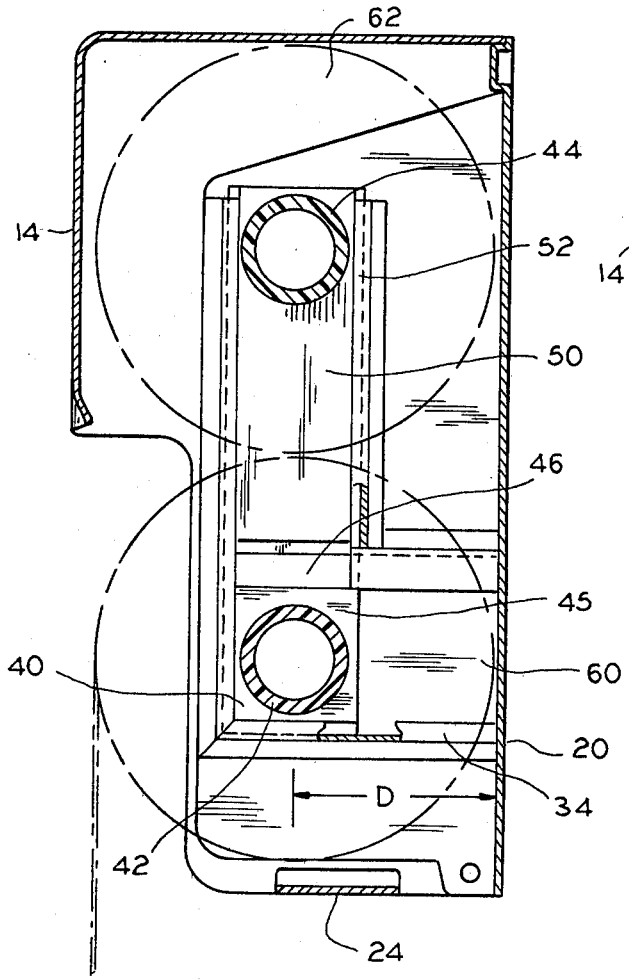
FIG. 3 is an enlarged side elevational view of the dispenser shown in FIG. 1 with the lower roll in the dispensing position.

In accordance with the invention, the side wall 16 includes a guide track 30 with a first track portion 32 and a second track portion 34 at right angles with the first track portion. As illustrated, the first and second track portions are formed by inturned flanges 36 welded or otherwise secured to a plate 38 which is fastened to the side wall 16. The first and second track portions form a track juncture at 40 (FIG. 3).

The invention provides first and second mandrels 42 and 44. The mandrel 42 is supported on a guide block or slide 45 which is movable back and forth in the track portion 34, as illustrated by the arrow 46 in FIG. 1. Mounting block 45 has a peripheral flange 47 on three edges with the peripheral flange being received in the track.

The mandrel 44 is provided with a mounting block 50 which has a peripheral flange 52 on three sides. The mounting block 52 is longer than the mounting block 45 and the mandrel 44 is located at the upper end thereof, as illustrated in FIGS. 1 and 3. Preferably the mounting or slide blocks 45, 50 are formed integrally with the mandrels by molding from plastic. Alternatively the mandrels can be formed from wood and secured to the mounting blocks by screws.

Figure 4:
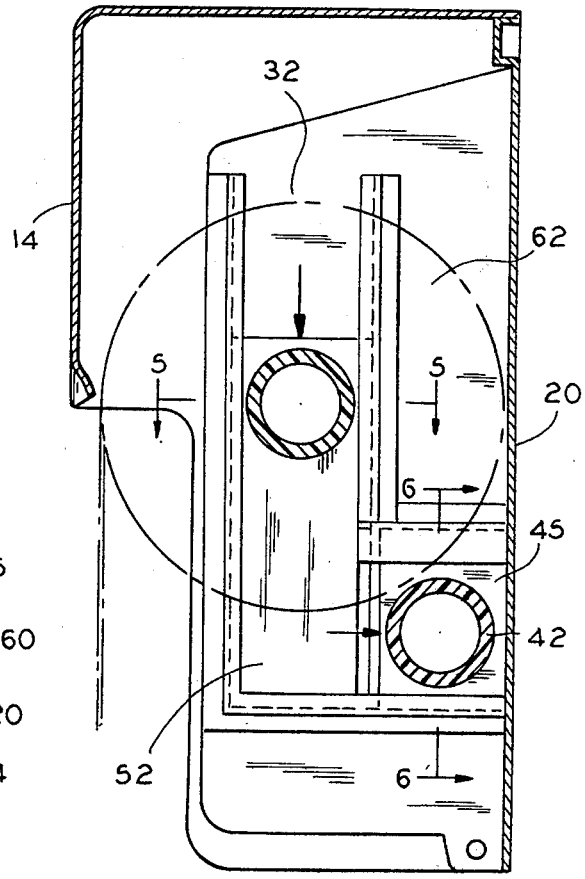
FIG. 4 is a view similar to FIG. 3 with the upper roll in the dispensing position.
Figure 5:
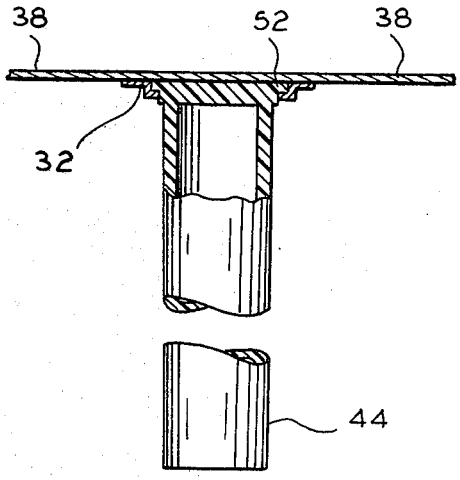
FIG. 5 is a sectional view along line 5—5 of FIG. 4.
Figure 6:
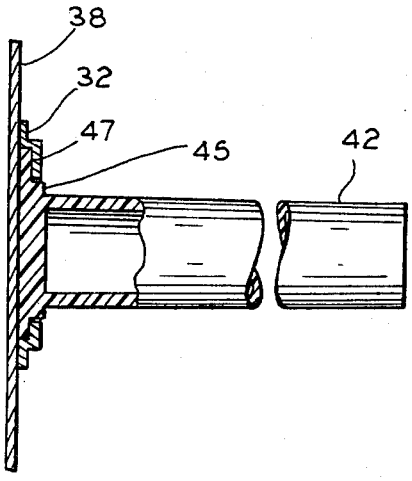
FIG. 6 is a sectional view along line 6—6 of FIG. 4.

The juncture 40 is spaced from the rear wall 20 by a distance D so that when the mandrel 42 is centered in the juncture 40 a full roll of toilet paper 60 can be accommodated therein. Similarly, the second track portion 32 is spaced from the rear wall so that the second mandrel 44 can accommodate a full roll of toilet paper 62. The guide block 45 is sized so that it cannot clear the juncture 40 to enable movement thereto of guide block 52 until the roll 60 is almost totally consumed or exhausted because the periphery of the non-exhausted roll 60 will abut the rear wall 20. Once the roll 60 has been exhausted, mandrel 42 is manually moved to the storage position shown in FIG. 4, thus moving the guide block 45 from the juncture, enabling the guide block 52 to be dropped into the juncture to provide access to the stored roll 62 in the dispensing position. As shown in FIG. 4, the guide block 52 when in a dispensing position locks the guide block 44 in the FIG. 4 empty spool storage position. Suitable instructions for manual movement of the mandrels can be provided on the dispenser housing.

We claim:

1. In a paper roll dispenser, including wall means defining an enclosure having an access opening for access to rolls of paper stored therein for dispensing therefrom, the improvement comprising first and second roll supporting mandrels, guide means on said wall means, said guide means including first and second intersecting track portions, slide block means integrally connected to said mandrels for supporting said mandrels in said guide means to afford first and second positions for each of said mandrels within said track portions with said slide block means for said first and second mandrels engaging and supporting said second mandrel in a first position in said track portions above said first mandrel a first position at said intersection of said first and second track portions and blocking downward movement of said second mandrel to said second position for dispensing when said mandrels are in said first position, and said first mandrel is in said first position for dispensing.

2. A dispenser for a paper roll comprising wall means defining an enclosure for confining first and second rolls of paper and defining an access opening opposite a rear wall to enable removal of sheets from said rolls, the improvement comprising first and second mandrels, slide blocks for supporting said mandrels in a cantilevered position, said slide blocks being integrally formed with said mandrels, guide tracks formed on a wall of said housing, guide tracks having first and second track portions, with said second portion being transverse to said first portion and said slide blocks being mounted for movement to said guide tracks and supporting said mandrels in a cantilevered position, and wherein said mandrels are movable from a first position with said first mandrel slide block located at the juncture of said first track portion and said second track portion and said second mandrel slide block being located above said first mandrel slide block in said first track portion when said mandrels are in said first position and wherein said first mandrel slide block can be moved from said juncture along said second track portion when sufficient paper is consumed from the roll carried thereon to open the juncture so that said slide block of said second mandrel can be moved into said juncture of said first and second track portions to expose said second roll to said access opening.

3. A dispenser in accordance with claim 2 wherein said rear wall is spaced from said juncture a distance such that said slide block for said first mandrel can only be removed from said juncture to enable movement of said second mandrel block in place thereof when almost all of the paper is consumed from the roll so that the roll is exhausted.

* * * * *